US006304028B1

(12) United States Patent
Vollkommer et al.

(10) Patent No.: US 6,304,028 B1
(45) Date of Patent: Oct. 16, 2001

(54) DISCHARGE LAMP WITH DIELECTRICALLY IMPEDED ELECTRODES

(75) Inventors: Frank Vollkommer, Buchendorf; Lothar Hitzschke, Munich, both of (DE)

(73) Assignee: Patent-Treuhand-Gesellschaft fuer Elektrishe Gluehlampen mbH (DE)

( * ) Notice: Subject to any disclaimer, the term of this patent is extended or adjusted under 35 U.S.C. 154(b) by 0 days.

(21) Appl. No.: 09/423,446

(22) PCT Filed: Mar. 2, 1999

(86) PCT No.: PCT/DE99/00543

§ 371 Date: Nov. 9, 1999

§ 102(e) Date: Nov. 9, 1999

(87) PCT Pub. No.: WO99/48134

PCT Pub. Date: Sep. 23, 1999

(30) Foreign Application Priority Data

Mar. 17, 1998 (DE) ..... 198 11 520

(51) Int. Cl.[7] ..... H01J 61/10; H01J 61/04; H01J 61/35; H01J 61/52

(52) U.S. Cl. ..... 313/491; 313/493; 313/607; 313/234; 313/634

(58) Field of Search ..... 313/488, 489, 313/491, 493, 607, 234, 634, 113

(56) References Cited

U.S. PATENT DOCUMENTS 5,220,236 * 6/1993 Washburn et al. ..... 313/493
5,514,934 * 5/1996 Matsumoto et al. ..... 313/607
5,869,931 * 2/1999 Terada ..... 313/607
5,932,960 * 8/1999 Terada et al. ..... 313/234

FOREIGN PATENT DOCUMENTS 0363832 4/1990 (EP) ..... H01J/65/00
0593311 4/1994 (EP) ..... H01J/64/04
9423442 10/1994 (WO) ..... H01J/65/00

* cited by examiner

*Primary Examiner*—Michael H. Day
(74) *Attorney, Agent, or Firm*—Robert F. Clark

(57) ABSTRACT

A discharge lamp (1) having an electrically conducting screen (12, 13) which at least partially surrounds the discharge vessel (2). The electrodes (3–5) are separated from the interior of the discharge vessel (2) by a dielectric barrier (6–8). Moreover, this screen (12, 13) is electrically separated from the electrodes (3–5) by a dielectric (2). In order largely to prevent the electric power fed to the lamp electrodes (3–5) during operation from being capacitatively coupled to the electrically conducting screen (12, 13), the thickness $d_B$ and the dielectric constant $\in_D$ of the dielectric (2), as well as the thickness $d_B$ and the dielectric constant $\in_D$ of the barrier (6–8), which separates the electrodes (3–5) from the gas filling, are specifically mutually coordinated such that the following relationship is fulfilled:

$$\frac{d_D}{\varepsilon_D} \geq 1.5 \cdot \frac{d_B}{\varepsilon_B}.$$

12 Claims, 1 Drawing Sheet

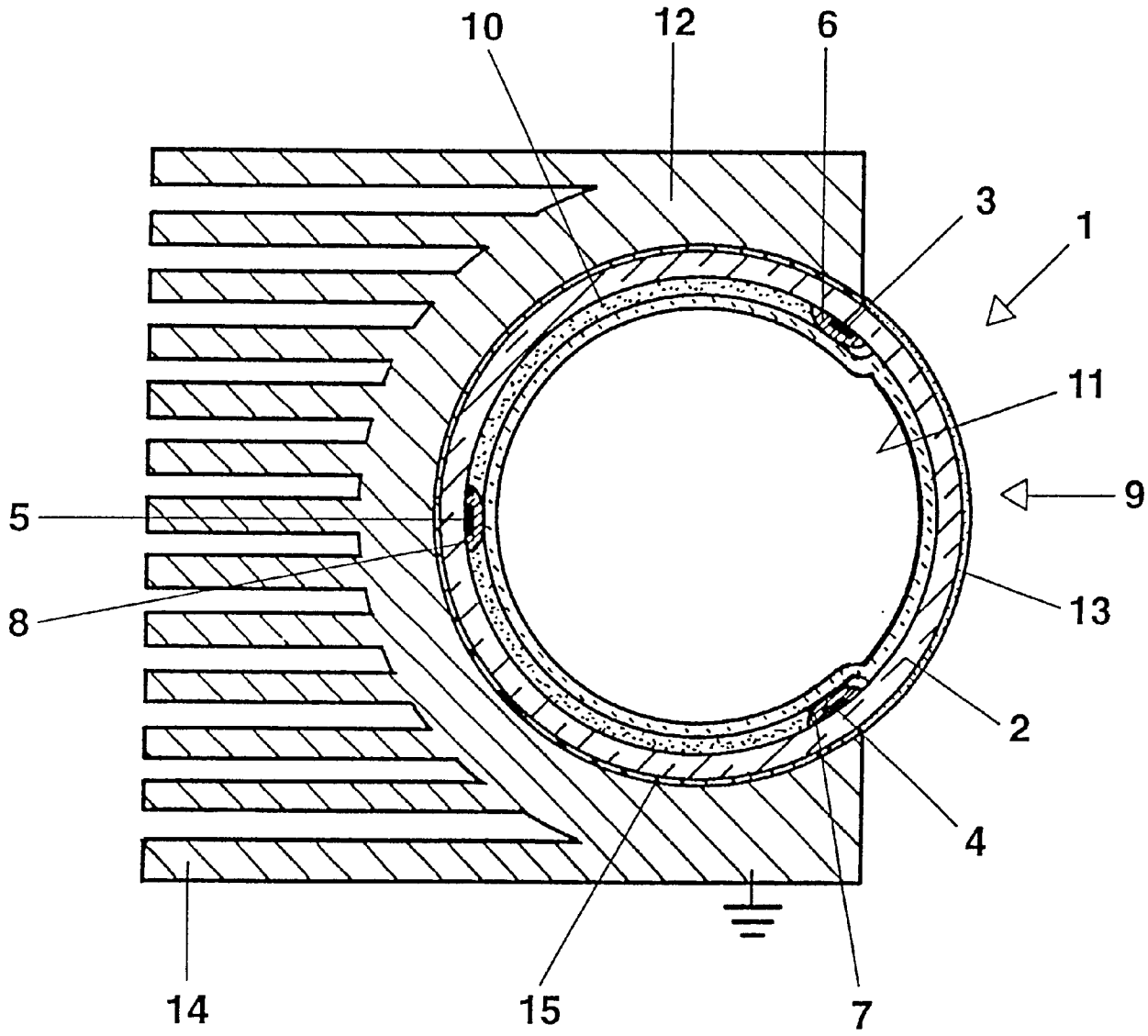
1
3
6
12
10
11
9
13
2
4
7
15
14
5
8

DISCHARGE LAMP WITH DIELECTRICALLY IMPEDED ELECTRODES

FIELD OF THE INVENTION

This discharge lamp has a discharge vessel enclosing a gas filling, at least parts of the discharge vessel being transparent to radiation of a desired spectral region, in particular light, that is to say visible electromagnetic radiation, or else ultraviolet (UV) radiation as well as vacuum ultraviolet (VUV) radiation. A number of electrodes generate a discharge in the gas filling given a suitable electric supply. Either the discharge directly generates the desired radiation, or the radiation emitted by the discharge is converted into the desired radiation with the aid of a luminescent material.

What is involved here, in particular, is a discharge lamp which is suitable for operation by means of dielectrically impeded discharge. For this purpose, either the electrodes of one polarity, or all the electrodes, that is to say of both types of polarity, are separated by means of a dielectric layer from the gas filling or, during operation, from the discharge (unilaterally or bilaterally dielectrically impeded discharge, see, for example, WO 94/23442 or EP 0 363 832). The designation of "dielectric barrier" is also used for this dielectric layer, and the term "barrier discharge" is also in use for discharges generated in such a way.

It remains to be clarified, in addition, that the dielectric barrier need not be a layer specifically applied to an electrode for this purpose, but can also be formed, for example, by a discharge vessel wall when electrodes are arranged on the outside of such a wall or inside the wall.

SUMMARY OF THE INVENTION

It is the object of the present invention to provide a discharge lamp with a reduced electromagnetic interfering radiation (EMI).

The invention proposes that the discharge lamp comprises an electrically conducting screen which at least partially surrounds the discharge vessel. Moreover, the screen is electrically separated by a dielectric from at least one electrode, also possibly from all the electrodes, depending on the electric potential relationships. In order largely to prevent the electric power fed to the lamp electrodes during operation from being capacitatively coupled to the electrically conducting screen, the thickness dD and the dielectric constant $\in_D$ of the dielectric, as well as the thickness $d_B$ and the dielectric constant $\in_D$ of the barrier, which separates the electrodes from the gas filling, are specifically mutually coordinated such that the following relationships are fulfilled:

$$\frac{d_D}{\varepsilon_D} \geq F \cdot \frac{d_B}{\varepsilon_B}$$

and F≧1.5, preferably F≧2.0, particularly preferably F≧2.5.

Below the lower limit, that is to say when the factor F is approximately 1.5, the electric power is already coupled to the screen at unacceptable intensity. Reliable operation of the dielectrically impeded discharge inside the discharge vessel of the lamp is then no longer reliably ensured under all operating conditions.

In principle, the capacitative decoupling of the screen from the dielectrically impeded discharge likewise increases with increasing factor F. Relatively high factors F are targeted, to this extent. For the case in which the dielectric constants of the dielectric and the barrier are approximately equal, high factors F signify a large ratio between the thicknesses of the dielectric and the barrier. In other words, it is necessary in this case for the thickness of the dielectric to be appropriately greater than the thickness of the barrier. However, the thickness of the dielectric is limited for reasons of cost and design. Consequently, all that remains is the possibility of reducing the thickness of the barrier, but this, in turn, places high demands on the precision of the barrier in order not negatively to influence the uniformity of the dielectrically impeded discharge. In the concrete individual case, it may be necessary here to accept a suitable compromise.

If the dielectric constant $Å_B$ of the barrier is, however, larger, or even substantially larger than the dielectric constant $\in_D$ of the dielectric, it is also certainly possible to realize correspondingly high factors F.

Numerous concrete refinements are conceivable with the abovementioned premises.

In a particularly advantageous refinement, the dielectric, which separates the screen from the electrodes, is formed by the wall of the discharge vessel itself. For this purpose, at least the electrodes at an electric potential different from the screen are specifically arranged on the inner wall of the discharge vessel. This procedure has the advantage, inter alia, that the above-named relationships can be effectively fulfilled as long as $\in_B$ is not chosen to be too small with respect to $\in_D$, since for mechanical reasons the wall of the discharge vessel is thicker as a rule than the barrier of the electrodes.

On the other hand, the dielectric between the screen and the electrodes can also be constructed from two or more layers with different dielectric constants. This can be expedient under some circumstances, particularly in the region of the electrodes, in order to be able reliably to fulfill the above-named conditions there in the case of a relatively thin discharge vessel wall. The barriers can also be constructed in principle from a plurality of layers with different dielectric constants.

In the case of the use of a plurality of layers, however, it is to be borne in mind that the two quotients are to be replaced in the above-named inequality by the sums $$\sum_i \frac{d_{DI}}{\varepsilon_{Di}} \quad \text{and} \quad \sum_i \frac{d_{Bi}}{\varepsilon_{Bi}},$$

$d_{Di}$, $\in_{Di}$, $d_{Bi}$, $\in_{Bi}$ denoting the thicknesses and dielectric constants, respectively, of the particular layer i. The index i takes the value 1 in the case of a single-layer system, the values 1, 2 in the case of a two-layer system, and the values 1, 2, . . . n, correspondingly, for an n-layer system.

It is likewise possible to arrange at least the electrodes with an electric potential differing from the screen to be arranged inside the wall of the discharge vessel. In this case, the arrangement of the electrodes is performed such that the layer, facing the interior of the discharge vessel, of the vessel wall is thinner than the layer facing the screen.

The screen is constructed, for example, as a metallic lateral surface with an opening. The opening defines the effective emitting surface of the lamp.

In a particularly advantageous variant, at least one part of the lateral surface is additionally further formed into cooling ribs. The lateral surface thereby assumes a double function, specifically on the one hand the action of screening, and on the other hand the dissipation of the lost heat generated by the discharge and/or, as the case may be, the electronics for operating the lamp. Since the lamp is expediently in particularly close contact with the lateral surface, good homogenization of the temperature distribution is also ensured along the contact zone between the lamp and lateral surface.

The screening action can be even further improved when at least the part, facing the opening of the lateral surface, of the outer wall of the discharge vessel is covered by an electrically conductive, transparent layer, for example made from indium tin oxide (ITO). In addition, the lateral surface and transparent layer are in mutual electric contact.

Furthermore, the lateral surface can also be implemented entirely by the electrically conductive, transparent layer. However, in this variant it is then necessary to dispense with the cooling action of the lateral surface.

The screen can be at a floating electric potential, but is advantageously connected to the potential at frame, for example earth, in order to prevent possible electromagnetic emission from the screen itself.

DESCRIPTION OF THE DRAWINGS

The FIGURE shows a cross section through a bar-shaped aperture fluorescent lamp with a screen, in a diagrammatic representation.

DETAILED DESCRIPTION OF THE INVENTION

The FIGURE shows an aperture fluorescent lamp 1 for OA (Office Automation) applications. The lamp 1 essentially comprises a tubular discharge vessel 2 which has a circular cross section and is surrounded by a screen, as well as three strip-shaped electrodes 3–5 which are applied to the inner wall of the discharge vessel 2 parallel to the tube longitudinal axis. Each of the inner wall electrodes 3–5 is covered by a dielectric layer 6–8. Furthermore, the inner wall of the discharge vessel. 2 is provided, with the exception of a rectangular aperture 9, with a double reflective layer 10 made from $Al_2O_3$ and $TiO_2$. A fluorescent layer 11 is applied to the double reflective layer 10, as well as to the vessel inner wall in the region of the aperture 9. The double reflective layer 10 reflects the light produced by the fluorescent layer 11. The luminous density of the aperture 9 is increased in this way.

The outside diameter of the tubular discharge vessel 2 is approximately 9 mm. Xenon is located inside the discharge vessel 2 at a filling pressure of 160 torr.

The electrodes 3–5 are led to the outside in a gas-tight fashion through a first end of the discharge vessel 2, and merge there into an outer supply lead (not represented) in each case. At its other end, the discharge vessel 2 is likewise sealed in a gastight fashion with the aid of a dome (not represented) formed from the vessel.

A first one 5 of the three electrodes 3–5 is provided for a first polarity of a supply voltage, and the two other electrodes 4, 5 are provided for the second polarity. The first electrode 5 is arranged diametrically relative to the aperture 9, and the two other electrodes 4, 5 are arranged in the immediate vicinity of the two longitudinal sides of the aperture 9. The width and the length of the aperture are approximately 6.5 mm and 255 mm, respectively.

The barrier consists of glass solder with a dielectric constant of approximately 8 and a thickness of approximately 250 $\mu$m. The result of this is a quotient of the barrier thickness to the dielectric constant of approximately 0.031 mm.

The discharge vessel 2 consists of low-alkali soda-lime glass (Schott #8350) with a dielectric constant of approximately 7 and a wall thickness of approximately 0.6 mm. The result of this is a quotient of the wall thickness to dielectric constant of approximately 0.086 mm. This quotient is approximately 2.77 times higher than the corresponding quotient for the barrier. Consequently, the relationship required in the general description is fulfilled here.

The screen of the lamp 1 comprises a solid, essentially cuboid, metallic lateral surface 12 and a transparent layer 13. The lateral surface 12 has an opening corresponding to the lamp aperture 9 in such a way that only the aperture 9 of the lamp remains visible from the outside. The transparent layer 13 consists of indium tin oxide (ITO) and covers the outer wall of the discharge vessel 2 only in the region of the aperture 9. The transparent layer 13 makes electric contact with the lateral surface 12 along its opening, and thereby completes the screening action of the lateral surface 12 with respect to EMI. The lateral surface 12 has a number of cooling ribs 14 on its side opposite the opening. A heat transfer compound 15 improves the heat transfer between the discharge vessel 2 and lateral surface 12.

The fluorescent layer 11 is a three-banded luminescent material. It consists of a mixture of the blue component $BaMgAl_{10}O_{17}$:Eu, the green component $LaPO_4$:Ce,Tb and the red component (Y,Gd)$BO_3$:Eu. The resulting colour coordinates are x=0.395 and y=0.383, that is to say the UV radiation produced by the discharge is converted into white light.

What is claimed is:

1. Discharge lamp (1)

having a discharge vessel (2) which is at least partially transparent and filled with a gas filling, a number of electrodes (3–5) which are arranged on or in walls of the discharge vessel (2), and at least one dielectric barrier (6–8) made from one or more layers with the thicknesses $d_{Bi}$ and with the dielectric constants $\in_{Bi}$ between at least one electrode (3–5) and the gas filling, suitable for a dielectrically impeded discharge in the discharge vessel (2) between electrodes of different polarity, characterized by an electrically conducting screen (12, 13) which surrounds the discharge vessel (2) at least partially, the discharge vessel (2) made from one or more layers with the thicknesses $d_{Di}$ and with the dielectric constants $\in_{Di}$, which electrically separates the screen (12, 13) from at least one electrode (3–5), and wherein $$\sum_i \frac{d_{Di}}{\varepsilon_{Di}} \geq 1.5 \cdot \sum_i \frac{d_{Bi}}{\varepsilon_{Bi}}.$$

2. Discharge lamp according to claim 1, in which the screen (12) is connected to a potential at frame.

3. Discharge lamp according to claim 2, in which the screen comprises a transparent layer (13) which is arranged at least on a subregion (9) of the outer wall of the discharge vessel (2).

4. Discharge lamp according to claim 3, in which the transparent layer (13) consists of indium tin oxide (ITO).

5. Discharge lamp according to claim 2, in which at least a part of the screen (12) is further formed into cooling ribs (14).

6. Discharge lamp according to claim 1, in which the screen comprises a transparent layer (13) which is arranged at least on a subregion (9) of the outer wall of the discharge vessel (2).

7. Discharge lamp according to claim 3, in which the transparent layer (13) consists of indium tin oxide (ITO).

8. Discharge lamp according to claim 7; in which at least a part of the screen (12) is further formed into cooling ribs (14).

9. Discharge lamp according to claim 6, in which at least a part of the screen (12) is further formed into cooling ribs (14).

10. Discharge lamp according to claim 1, in which the electrodes (3–5) are arranged on the inner wall of the discharge vessel (2).

11. Discharge lamp according to claim 10, in which at least a part of the screen (12) is further formed into cooling ribs (14).

12. Discharge lamp according to claim 1, in which at least a part of the screen (12) is further formed into cooling ribs (14).

* * * * *